US011679913B2

(12) United States Patent
Tamarit Rios

(10) Patent No.: US 11,679,913 B2
(45) Date of Patent: Jun. 20, 2023

(54) CROWN CAP

(71) Applicant: DESARROLLOS TAMARIT PLAZA SL, Valencia (ES)

(72) Inventor: Ramón Tamarit Rios, Valencia (ES)

(73) Assignee: DESARROLLOS TAMARIT PLAZA SL, Valencia (ES)

( * ) Notice: Subject to any disclaimer, the term of this patent is extended or adjusted under 35 U.S.C. 154(b) by 0 days.

(21) Appl. No.: 17/778,239

(22) PCT Filed: Nov. 20, 2019

(86) PCT No.: PCT/ES2019/070795
§ 371 (c)(1),
(2) Date: May 19, 2022

(87) PCT Pub. No.: WO2021/099650
PCT Pub. Date: May 27, 2021

(65) Prior Publication Data

US 2023/0018966 A1 Jan. 19, 2023

(51) Int. Cl.
*B65D 41/42* (2006.01)

(52) U.S. Cl.
CPC ..... *B65D 41/42* (2013.01)

(58) Field of Classification Search
CPC ..... B65D 41/42; B65D 41/40; B65D 41/44
USPC ..... 215/295, 303, 304, 305
See application file for complete search history.

(56) References Cited

U.S. PATENT DOCUMENTS 1,978,272 A * 10/1934 Lawrence ..... B65D 51/243 215/305
2,162,182 A * 6/1939 Smith ..... B65D 41/42 215/254
3,137,403 A * 6/1964 Welber ..... B65D 41/12 215/328
3,425,580 A * 2/1969 Brockhage ..... B65D 51/243 215/305
5,265,746 A * 11/1993 Lee ..... B65D 51/243 215/303
5,582,309 A * 12/1996 Bruhn ..... B65D 41/12 215/301
2016/0138358 A1* 5/2016 Whitby ..... E21B 33/064 166/363

FOREIGN PATENT DOCUMENTS

DE 44 06 917 A1 8/1995
DE 296 00 761 U1 11/1996
WO 2014/198967 A1 12/2014

OTHER PUBLICATIONS

Written Opinion for PCT/ES2019/070795, dated Aug. 31, 2020.
International Search Report for PCT/ES2019/070795, dated Aug. 31, 2020.

* cited by examiner

*Primary Examiner* — J. Gregory Pickett
*Assistant Examiner* — Niki M Eloshway
(74) *Attorney, Agent, or Firm* — Sughrue Mion, PLLC

(57) ABSTRACT

The present invention relates to a crown cap for bottles of the type constituted by a metal plate, although it could be made of another material, having a structural configuration which favors the opening operation of the bottle by means of the removal of the crown cap with the thumb of the hand holding the bottle.

7 Claims, 9 Drawing Sheets

CROWN CAP

CROSS REFERENCE TO RELATED APPLICATIONS

This application is a National Stage of International Application No. PCT/ES2019/070795 filed Nov. 20, 2019.

OBJECT OF THE INVENTION

The invention, crown cap for bottles of the type constituted by a metal plate, although it could be made of another material, presents the particularity of having a structural configuration which favors the opening operation of the bottle by means of the removal of the crown cap with the thumb of a single hand which holds the bottle and without requiring an opener, although an opener can also be used to remove the crown cap.

The field of application of the present invention is encompassed within the sector of the industry dedicated to the manufacturing of caps, specifically focusing on the scope of crown-type caps.

BACKGROUND OF THE INVENTION

As is known, crown-type caps for bottles are broadly known, an opener being necessary in the majority of the cases to extract them from the bottle, given that they are adjusted on the rim thereof in its entire perimeter. However, to avoid using the opener, there are some types of crown caps which have means to also open them manually, as is the case of the cap of the present invention.

For example, the documents of the prior art U.S. Pat. No. 2,162,182, DE29600761 and DE4406917 describe crown caps which can be opened manually. Document U.S. Pat. No. 2,162,182 describes a crown cap which is based on a sheet with a circular body which perimetrally presents a plurality of folds once it has been adjusted to the mouth of the bottle, the sheet comprising an extension arising from the circular body and comprising a continuous cut in said extension which determines a flap with an inverted U-shaped surface. Document DE29600761 describes a corrugated cap with an integral opening aid, specifically a planar lever similar to a peak, formed from and integrated with laminar metal of the cap, and can have a finger hole like a can ring. Document DE4406917 relates to a crown cap with an opening lever which has cap ridges continued over the length of the lever which is joined on the broad width of the cap and ends in a flat gripping area. Likewise, international application WO2014198967 of the same applicant describes a cap with a circular body and an extension starting from said circular body, being provided with several sections which together with a cut flap on one of the sections of the extension allow, by means of bending the sections with the thumb, exerting a pressure on the circular body to thus open the bottle by removing the circular body.

However, there are in the state of the art, and particularly in the product described in document WO2014198967, certain drawbacks such as the possible displacement of the inverted U-shaped flap upon exerting pressure on the circular body or crown or the folding of the extension at points or places in which it is not required, thus hindering the removal of the crown or cap and therefore the opening of the bottle.

DESCRIPTION OF THE INVENTION

Thus, the crown cap object of the present invention, is preferably constituted from a metal plate or sheet, but not limited thereto, given that it may also be manufactured from other materials, for example plastic, which is configured from a circular body perimetrally provided with a plurality of folds generated for its adjustment to the rim of the mouth of a bottle, having a lateral extension which stretches from the edge of said circular body and which, when folded, determines a folded arm constituting the manual opening means of the cap.

Specifically, the aforementioned extension presents a continuous cut that determines a flap with an inverted U-shaped surface, and preferably with a perimeter reinforcement rib along the sides of the flap, the purpose of which is to support the triangle formed by lifting said arm, and the lifting of which will contribute to the separation of the inverted U-shaped surface of the flap, which will be supported against the rim or base of the cap, and will lift the set to thus separate the cap from the bottle. Weakening or folding points or lines may be arranged at both sides of said cut or flap that contribute to the folding of the external section to form the triangle. The inverted U-shaped cut or flap presents two lateral sides and one upper side, being joined to the external section by a lower side opposite to said upper side. The lateral sides may be parallel or non-parallel, that is to say, such that the cut or flap presents a square or rectangular, or even trapezoidal, shape. Likewise, the cut or flap may have other shapes equivalent to the one being described, such as a V-shape, for example.

In addition, and as described in claim 1, the cap object of the present invention has on the upper side of the flap, which is the one located closest to the circular body, at least one recess intended to house at least one of the folds of the circular body which are used to adjust the cap object of the invention to the mouth of the bottle when the flap is supported on the circular body of the cap, thus avoiding possible displacements of the upper side of the flap in its support. With this recess, the upper side of the flap is adapted to the folds of the cap in the circular body and a better support is achieved with respect to the state of the art for an optimal opening of the cap. Said recess in the cap preferably presents a rounded shape, although it is possible for it to present a trapezoidal, triangular shape or another geometrical shape. The flap is preferably M-shaped, presenting the recess rounded.

In addition, the flap presents on each side of the lateral sides thereof a longitudinal rib ensuring that the folds and bends of the extension, necessary for an optimal opening of the cap, are in the exact places to achieve that the flap acts on the ideal point of the circular body of the cap. Said ribs are preferably parallel to the lateral sides of the flap.

At the lower end of the mentioned upper ribs close to the lower side of the flap, there is arranged a calibrated stamping which allows folding the flap over the lower side only once, such that it is ensured that the extension or arm can only be folded once at that point, ensuring its breakage in the event that the attempt is made to use it again. By means of this measure, in addition to a correct folding of the flap, the inviolability of the cap is ensured, acting as a safety seal.

Likewise, the lateral extension of the cap presents a weakening line which remains in the internal or rear part of the arm when folded, in contact with the bottle, and when the arm is lifted, it allows the easy folding of the extension, creating the three sides of the triangle along the cut or flap with the inverted M-shaped surface. This triangle allows applying a lever force with a finger, enabling the opening of the cap. Once the arm is folded, the free end located in the internal or rear part thereof can be located under the circular body, such that when it is adjusted to the rim of the mouth of a bottle will be trapped between the lower surface of the circular body and the rim of the bottle. Likewise, once the end of the arm is located in the lower end of the circular body, a coating is preferably applied on said internal surface of the circular body including the end of the arm, the objective of which coating is to cover the inside of the circular body and the end of the arm to achieve the necessary sealing and airtightness between the rim of the mouth of the bottle and the cap to prevent the exit of the liquid and $CO_2$ that the bottle may contain therein. Likewise, it allows improving the connection between the final end of the arm and the circular body. Said coating can be of any material which complies with the necessary hygiene requirements according to the contents of the bottle, and will preferably be of a PVC (polyvinyl chloride) type.

The aforementioned folded arm or extension may also have longitudinal ribs in the upper and lower parts of the weakening line described above, which serve to guarantee the rigidity of the entire body when folding said area. The cut or flap may likewise present perpendicular or non-perpendicular reinforcement ribs on the upper side thereof. Said ribs may also present different shapes, according to the manufacturing process used, as well as the structural needs thereof, being able to be concave, convex, with different shapes different to the longitudinal and different location.

Therefore, the crown cap is configured from a sheet with a circular body that perimetrally presents a plurality of folds after being adjusted to the rim of the mouth of a bottle, said sheet comprising an extension arising from the circular body and comprising a first transverse folding line to determine a folded arm with two sections, an upper or external or front section, and a lower or internal or rear section located between the external or front section and the bottle; and a continuous cut on the external or front section of the extension and which determines a flap with an inverted M-shaped surface.

Based on said configuration, by lifting the free end of the extension or arm folded at the first transverse folding line to separate the cap and open the bottle, the cut or flap with an inverted M-shaped surface is separated from the upper or external section of the arm, ceasing to be coplanar as a consequence of the deformation of said external or upper section, preferably caused by weakening or folding points or lines made in the upper or external section at both sides of the flap or cut. Likewise, the upper side of said flap becomes a supporting point or area on a fold of the cap arranged in the mouth of the bottle.

Said weakening or folding points or lines, which may be arranged both in the external or upper section and in the internal or lower section, cause the folding of the sections at said points or lines when lifting the arm, creating a triangle alongside the flap, the upper side of which comes into contact with, as mentioned above, the rim of the cap adjusted to the mouth of the bottle. The surface of the flap comes into contact with said rim at an angle between 30° and 60° , preferably being as close as possible to 45° .

Lastly, the cap may include two small transverse cuts on opposite sides of the perimeter of the circular body, which will facilitate the final opening of the cap after lifting the lateral arm, exerting the support of the inverted M-shaped cut on the starting point of the extension, and finally collapsing the tear in the upper part of the cap, to favor the folding of the cap in said two opposite points of the perimeter.

To prevent possible injuries, mainly cuts, while handling the cap, the borders of the sheet forming it do not have square corners.

The cap object of the present invention therefore has, with respect to the documents of the state of the art, a more reliable construction ensuring the opening of the cap with one hand, avoiding unnecessary displacements of the upper side of the flap when it is supported on the rim of the cap, while at the same time due to the reinforcements in the upper section of the extension on both sides of the flap, the folding and the rigidity of the different parts of the cap are achieved.

DESCRIPTION OF THE DRAWINGS

To supplement the description being made, and for the purpose of aiding to better understand the features of the invention, a set of illustrative and non-limiting figures is attached to the present specification.

FIG. 11 shows a perspective view of the internal side of the crown cap, observing how the end of said extension is located on the internal face of the circular body.

PREFERRED EMBODIMENT OF THE INVENTION

Figure 1:
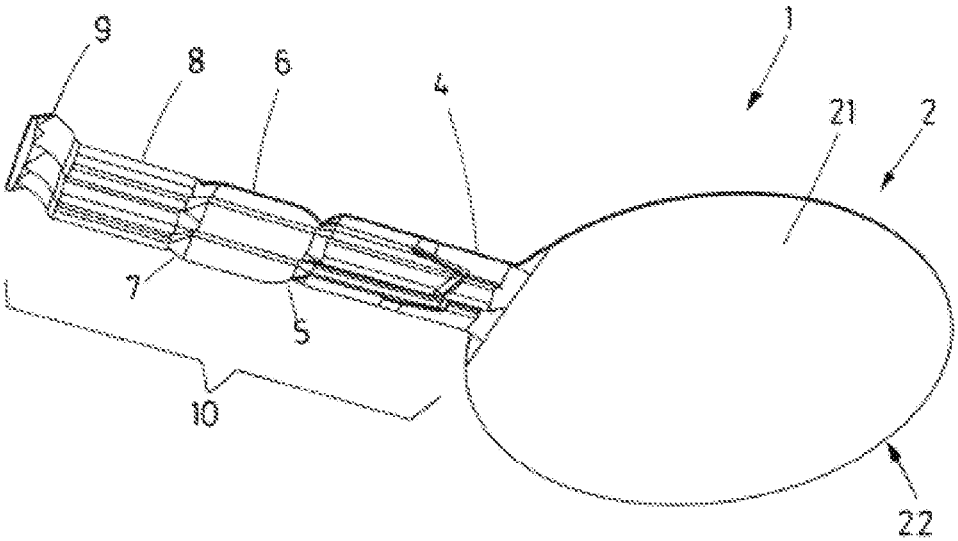
FIG. 1 shows a perspective view of an embodiment of the crown cap, object of the invention, represented in a fully deployed position with the planar circular body.

Based on the aforementioned figures, a preferred but non-limiting embodiment of the crown cap object of the invention is described below.

Thus, as shown in said figures, the cap (1) in question is configured from a circular body (2) which, conventionally and after its folding, perimetrally presents an annular area with a plurality of folds (3) for the adjustment of said circular body (2) to the rim of the mouth of the bottle after installing the cap on the mouth of said bottle. The cap object of the invention has the particularity of having a lateral extension or arm (10) which arises from the edge of said circular body (2) and which is designed to be folded at determined places, determining a folded arm which will constitute the component which will allow the opening of the cap (1).

Said lateral extension (10) is perimetrally divided into two sections, upper (4) and lower (6, 8, 9), separated by a transverse folding line (5), where it is folded to form the aforementioned folded arm (10), such that the upper section (4) is located in the external or front part of the cap, and the lower section (6, 8, 9) in the internal or rear part thereof, this lower, internal, or rear section (6, 8, 9) being specifically located between the bottle and the upper, external, or front section (4).

Figure 2:
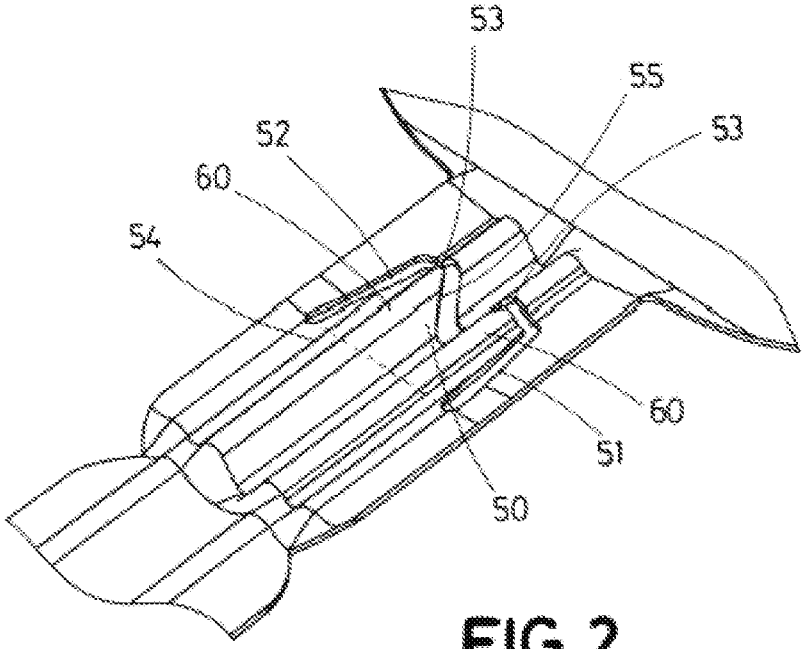
FIG. 2 shows a detail of the flap arranged in the upper section of the arm or extension of the cap object of the invention.

As can be observed in FIG. 2, in the upper, external or front section (4) of this extension (10) there is a cut with a recess (55) on one of its sides, determining a flap (50), the separating cut extending between the flap (50) and the upper section (4) over the entire perimeter of the flap (50), except on one side where it serves as a joining between the flap (50) and the upper section (4) The sides of said flap (50) which are separated from the upper section (4) by a cut are, like the flap (50), coplanar with the same prior to being used. The upper side (53) of the flap (50), having the recess (55), constitutes the supporting side which, afterwards and as will be explained below, will cause the opening of the cap.

The upper side (53) of the flap (50) in the upper, external or front section (4) of this extension (10) presents, on the upper side (53) of the flap (50), which is the located closest to the circular body (2), at least one recess (55) intended to house at least one of the folds (3) which are created in the circular body (2) when it is folded. Said folds (3) are used to adjust the cap (1) to the mouth of the bottle, as well as to be introduced in the recess (55) when the flap (50) is supported on the circular body (2) of the cap (1), thus avoiding possible displacements of the flap (50) in its support. With this recess (55) in the flap (50), the upper side (55) thereof is adapted to at least one of the folds of the cap (1) formed in the circular body (2) to achieve a better support of the flap (50) on the circular body (2) compared to the solutions of the state of the art. Said recess (55) in the flap (50) preferably presents a rounded shape, although it is possible for it to also present a trapezoidal, triangular shape or another geometrical shape. The flap preferably has an inverted U shape, but with this recess, therefore determining an M shape, with the recess (55) preferably rounded.

Therefore, the flap (50) would be determined by a lower side, of joining (54) to the upper section (4) of the extension or arm (10), two lateral sides (51, 52) separated from the upper section (4) and an upper side (53) with the aforementioned recess (55). Between both lateral sides (51, 52) and the recess (55) of the upper side (53), i.e., on each side of the recess (55), there is arranged a fold (60) in the upper section (4) acting as a reinforcement rib of the flap (50) during the removal of the cap (1) to open the bottle. Said longitudinal ribs ensure that the folds and bends of the arm (10) occur in the predisposed exact places for the flap (50) to act on the fold (3) and specific point of the circular body (2) of the cap (3). Said ribs (60) are preferably parallel to the lateral sides (51, 52) of the flap (50).

At the lower end of the aforementioned ribs (60), close to the lower side (54) of the flap (50), there is arranged a calibrated stamping which allows folding the flap (50) over the lower side (54) only once, such that it is ensured that the flap (50) can only be folded once in that line, ensuring its breakage in the event that the attempt is made to use it again. By means of this measure, in addition to a correct folding of the flap (50), the inviolability of the cap (1) is ensured, said stamp acting as a safety seal. This is achieved by means of a reduction of the thickness of the flap in said folding line.

Likewise, the lower, internal, or rear section (6, 8, 9) has two transverse weakening lines (5, 7), there being longitudinal ribs above and below said weakening lines (5, 7) intended to provide rigidity to the entire arm (10) when it is folded.

Figure 3A:
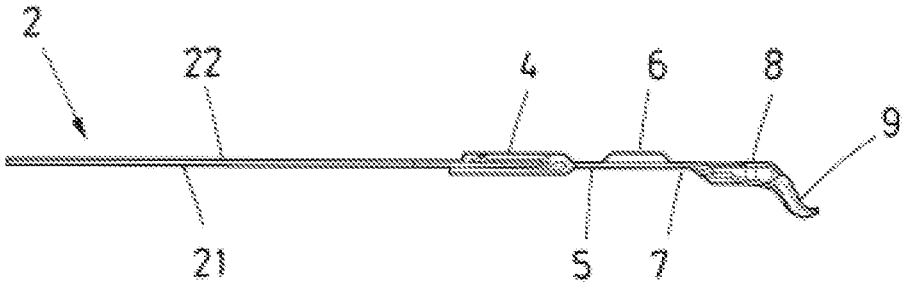
FIG. 3A shows a lateral view of the crown cap with its planar circular body.
Figure 3B:
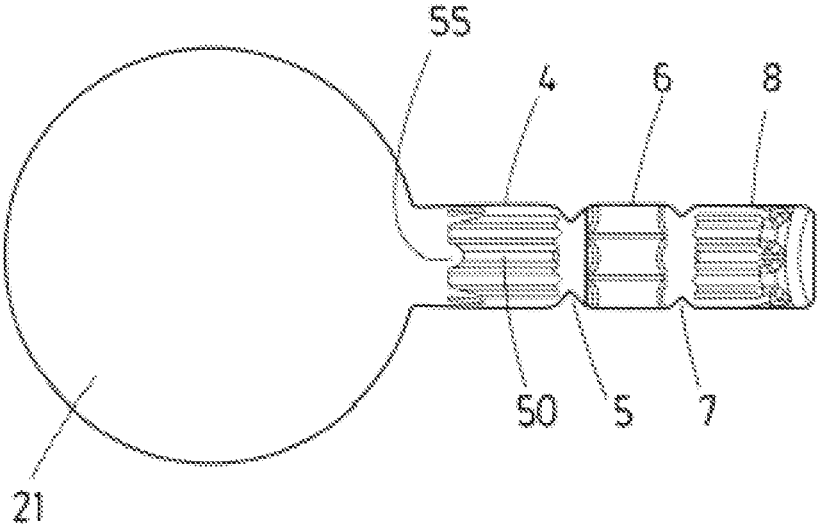
FIG. 3B shows an upper elevational view of the crown cap with the planar circular body.

FIG. 1 shows the cap object of the invention prior to its arrangement and closing on the mouth of a bottle. Said figure shows the extension or arm (10) prior to being folded with the two sections, upper, front, external (4), and lower, front, internal (6, 8, 9) with the folding lines (5, 7) of the arm (10), as well as the rest of the components of the cap (1). Specifically, the first folding line (5) is located between the upper section (4) and the first area (6) of the lower section (6, 8, 9) and the second folding line (7) is located between the first area (6) and the second area or free end (8, 9) of the lower section (6, 8, 9). At the end of the arm (10) the upper surface is observed. FIGS. 2 and 3 show the cap in a situation like in FIG. 1, prior to the placing on the bottle.

Figure 4:
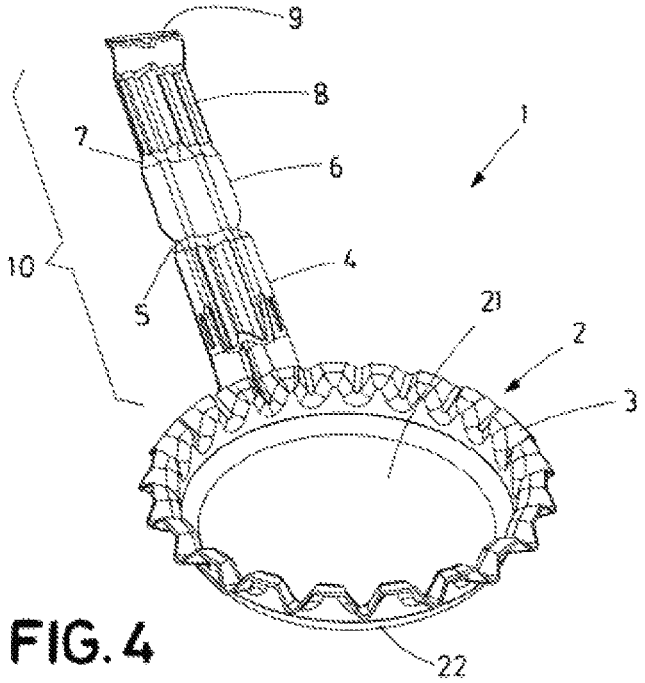
FIG. 4 shows a perspective view of the example of the crown cap, according to the invention, shown in FIG. 1, represented in this case with the circular body provided perimetrally with a plurality of folds which are generated for its adjustment to the rim of the mouth of a bottle and showing the inside of the cap.
Figure 5:
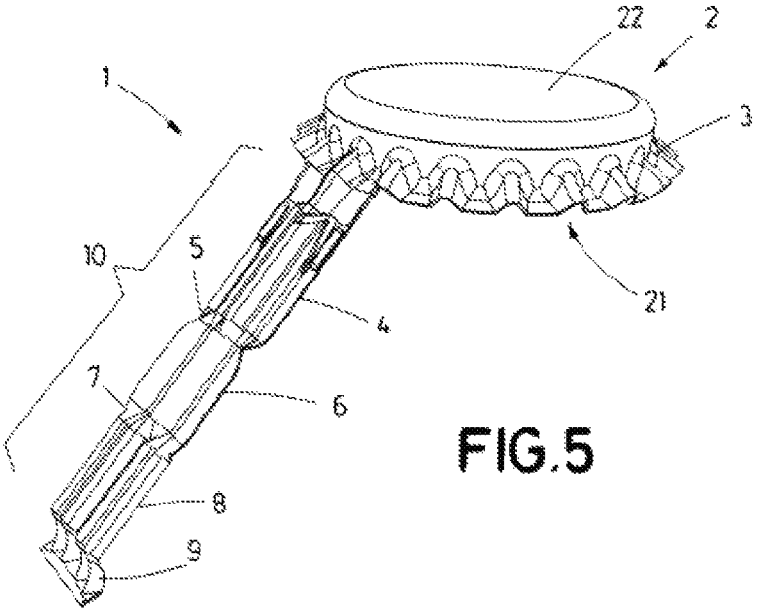
FIG. 5 shows a lateral perspective view of the crown cap, represented in an extended or deployed position and observing the external part of the cap.

FIGS. 4 and 5 show the cap, prior to its assembly on the bottle with the extension (10) arranged inclined with respect to the circular body (2) of the cap and the folds (3) already made on said circular body (2). The internal surface 21 of the circular body (2) which will be supported on the rim of the neck of the bottle is observed. FIG. 3 shows a detail of the extension (10) and of the two sections (4 and 6, 8, 9) prior to their folding at the weakening line (5) for the formation of the folded arm (10) for opening the cap (1). On the other hand, FIG. 4 shows a view opposite to the previous one, in which the external surface (22) of the circular body (2) after the formation of the perimetral folds (3) is observed.

Figure 6:
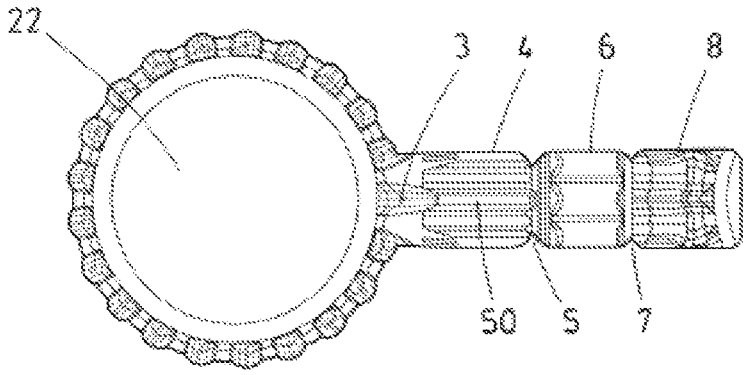
FIG. 6 shows an upper elevational view of the crown cap with the circular body with the folds incorporated.
Figure 7:
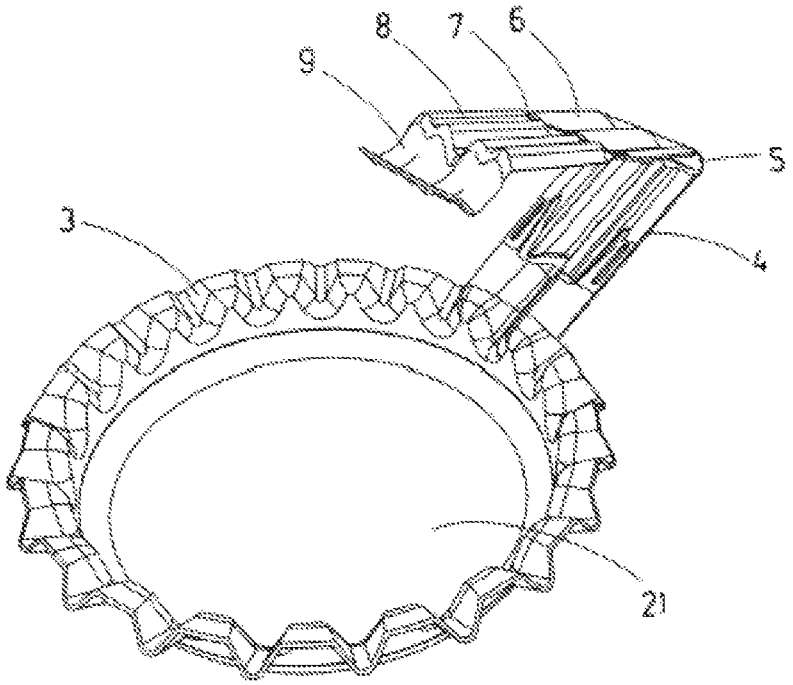
FIGS. 7 and 8 again show a perspective view of the inside and the outside, respectively, of the example of the crown cap, according to the invention, shown in the previous figures, in this case represented with the lateral extension partially folded over the circular body.
Figure 8:
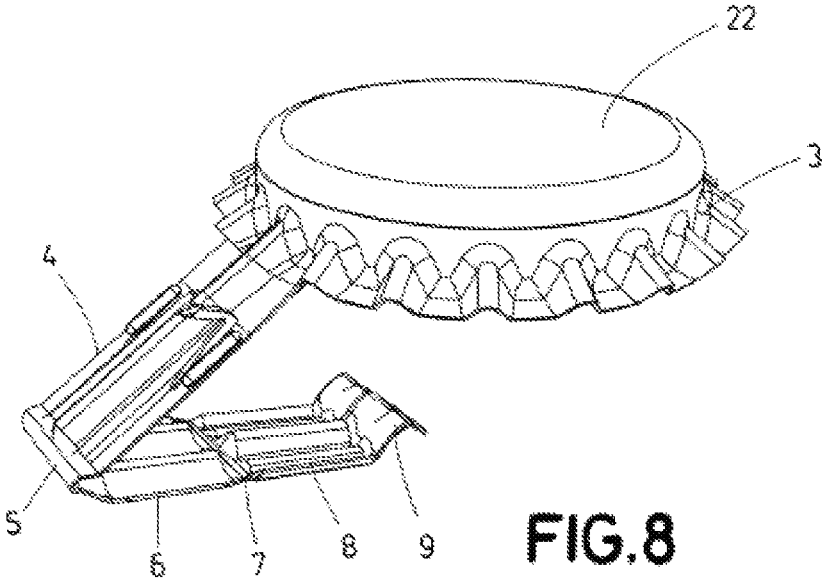
Figure 9:
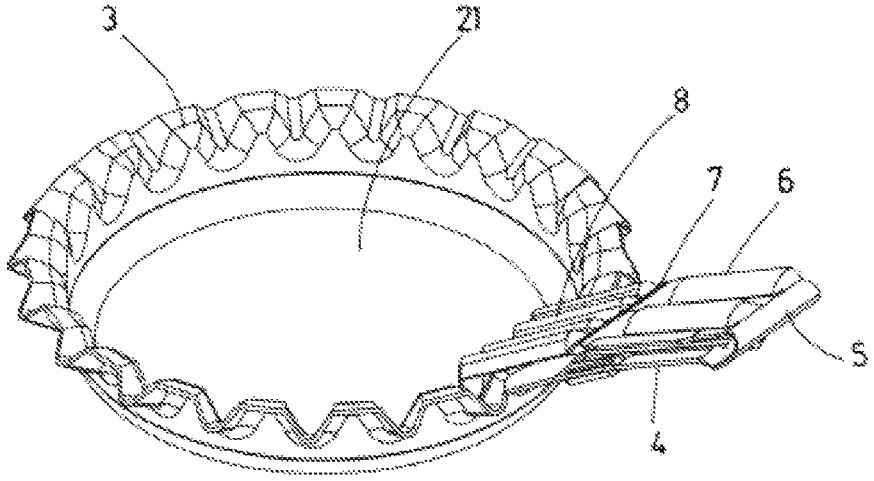
FIGS. 9, 10 and 11 show three perspective views, of the outside and the inside, of the crown cap, with the lateral extension partially folded over the circular body.

FIGS. 7 and 8 show the arm (10) partially folded with respect to the first folding line (5), it being observed how the free end (8, 9) of the internal, rear or lower section (6, 8, 9) and specifically the free end (9) of said section, is slightly curved with a concave shape, according to FIG. 5, or convex shape, according to FIG. 6, to adapt to the shape of the indentation formed in the circular body (2) of the cap after making the folds (3), such that said final end (9) is supported on the lower surface (21) of the circular body (2), as observed in FIG. 9.

Figure 10:
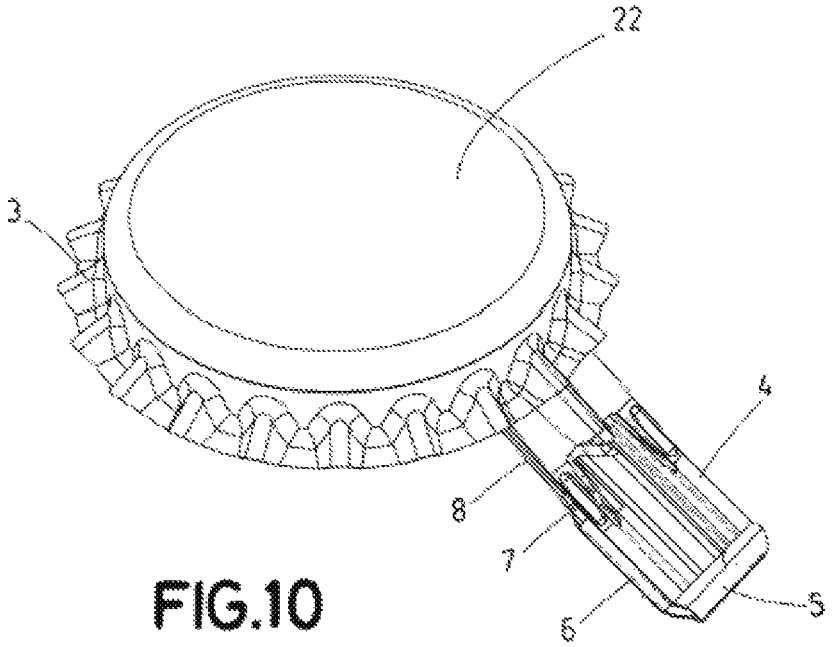
Figure 11:
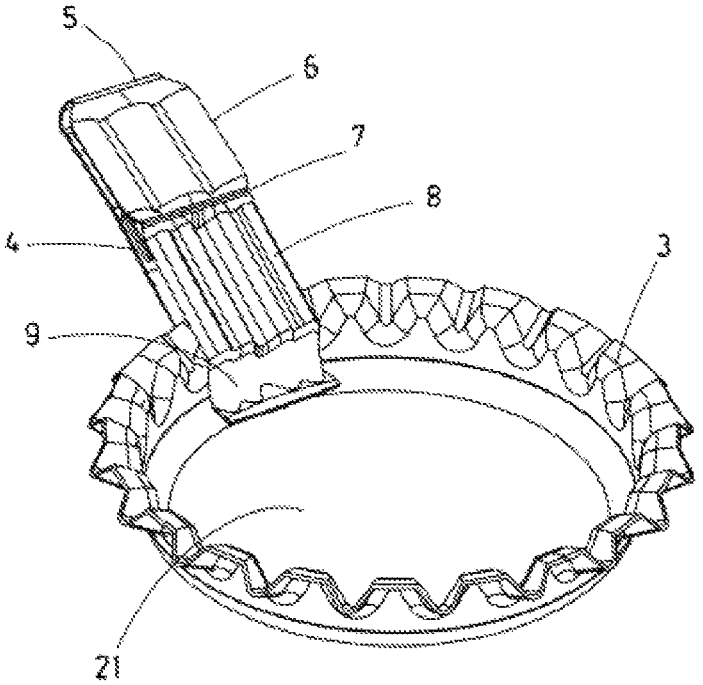

FIGS. 9 to 11 show the arm or extension (10) completely folded, such that the lower section (6, 8, 9) is folded over the upper section (4) upon folding the arm (10) through the first folding line (5). Specifically, the first area (6) of the lower section is on the upper section (4) and the second area (8) of said lower section is one part on the upper section (4) and another part on the internal surface of the folds (3) of the circular body (2).

Likewise, once the final end (9) of the arm (10) is located on the lower part of the circular body (2) against the internal surface (21) of said body (2), a coating is preferably applied on said internal surface (21) of the circular body (2). Said coating covers the internal surface (21) and the final end (9) of the arm (10). The objective of said coating is to cover the inside of the circular body (2) and the final end (9) of the arm (10) to achieve the necessary sealing and airtightness between the rim of the mouth of the bottle and the crown cap object of the invention. Said coating can be of any material which complies with the necessary hygiene requirements according to the contents of the bottle, and will preferably be of a PVC (polyvinyl chloride) type.

Figure 12:
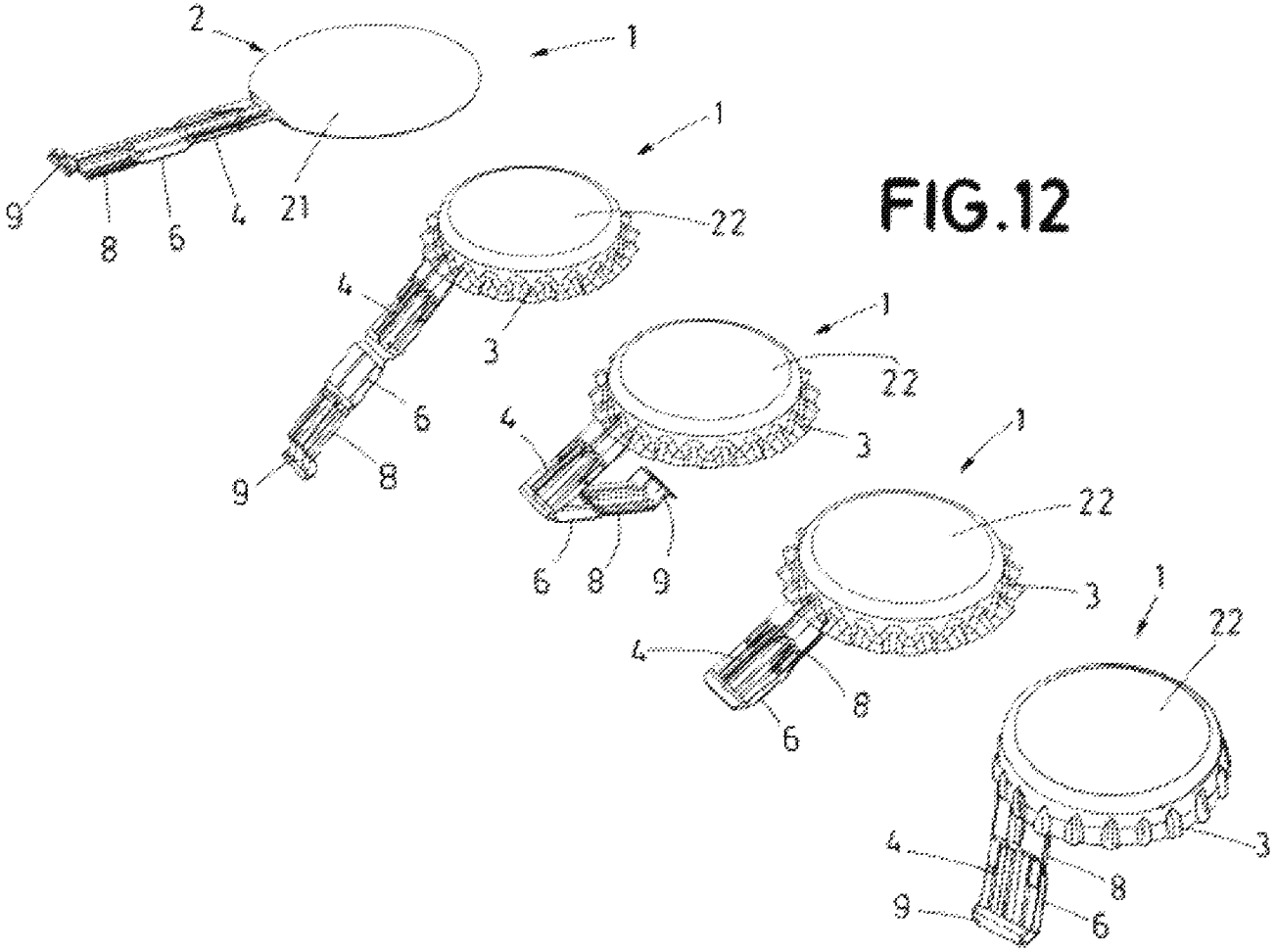
FIG. 12 shows the development of the cap from its position prior to the assembly until its situation of assembly on a bottle.

FIG. 12 shows the cap (1) object of the invention in the different steps (from left to right) prior to the assembly on the mouth of a bottle, not shown, in which there can be observed the folds (3) of the cap which are adjusted on the bottle and the extension or arm (10) with the upper section (4) and the lower section (6, 8, 9) folded over one another. In the final step, the figure on the right of the sequence, the cap is already located on the bottle, the folds (3) being already fixed thereto (it is observed how their shape is different with respect to the previous three figures).

It should be noted that the ribs arranged in the different parts of the crown cap, mainly as reinforcement elements, are important for the transmission of forces and to obtain the opening of the cap, but it should be highlighted that the size and number thereof will depend on the material of the crown cap as well as the manufacturing process.

Figure 13:
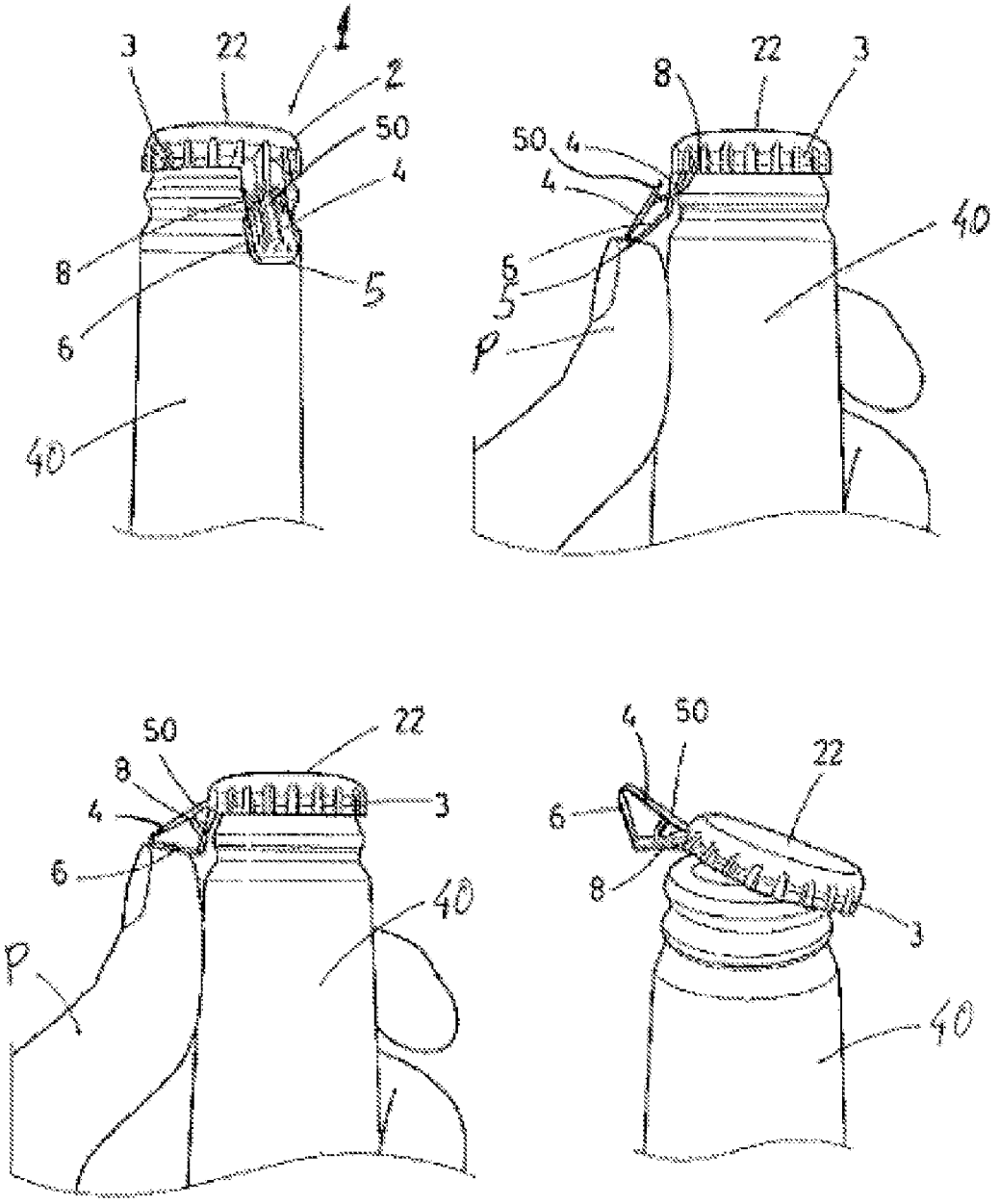
FIG. 13 shows the opening process of the cap object of the invention in four steps.

After locating the cap (1) on the bottle in the position of the last sequence of FIG. 12, simply proceeding with the following steps will be enough to proceed with the opening, which steps will cause the opening of the aforementioned cap and are shown in FIG. 13:

Lifting, preferably with the thumb (P) while the rest of the fingers of the hand hold the bottle by its neck (40), the arm (10) at the folding line (5), such that the arm (10) starts to pivot around its area of contact with the circular body (2) of the cap. It is important for said folding line (5) to not contain a square corner, given that the upward force shall be applied at that point, preferably with the thumb, to thus avoid cuts in said finger, due to which a curved line will preferably be generated at said point.

Figure 14:
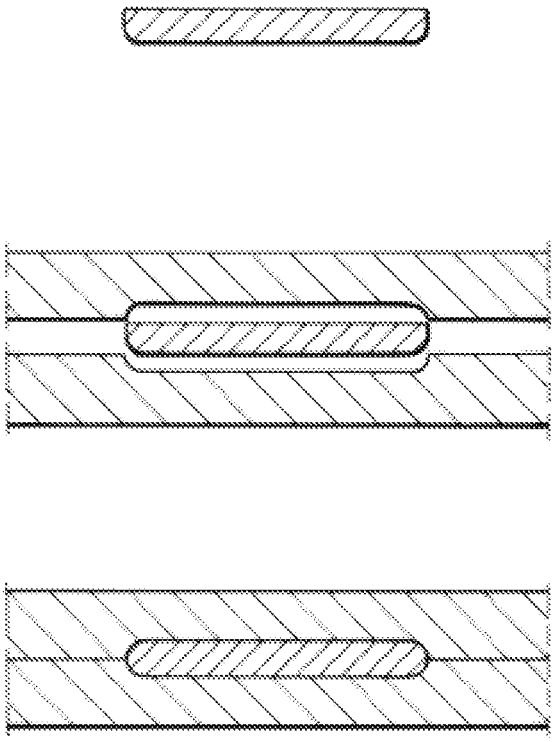
FIG. 14 shows three steps for rounding the borders of the flap of the cap and avoiding cuts thereon.
Figure 15:
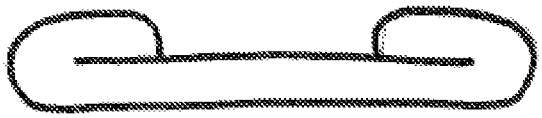
FIG. 15 shows an alternative to FIG. 14 for rounding the borders.

Likewise, in a similar manner, and to avoid possible injuries, mainly cuts, while handling the cap, none of the borders of the sheet forming it presents sharp corners, and in particular all those corners which may come into contact with the user during handling. FIG. 14 shows a manufacturing sequence for the folding of the borders by means of pressing, and FIG. 15, shows an alternative for avoiding said sharp corners. Said FIG. 15 shows a section of the flap, in which the edges or borders thereof are folded, such that they would partially or completely round all the corners. It would also be possible to apply this to the circular body of the cap and not only the flap.

The force exerted by the thumb (P) on the first folding line (5) of the extension (10) with its upper section (4) and its lower section (6, 8, 9) folded over one another, causes two movements: on the one hand, the separation of the same plane of all the sides of the flap (50) except the lower side (54) of joining with the upper section (4), and, in turn, the folding of the lower, rear, internal section (6, 8, 9) through the second folding line (7). In particular, in the separation of the same plane of the flap (50) of the upper section (4), the two lateral sides (51, 52) of the flap (50), the upper side (53) and the recess (55) thereof are offset from the plane of said upper section (4).

The separation of the three sides of the cut of the flap (50) from the upper section (4) may be favored by the arrangement of weakening or folding points, which may become weakening or folding lines (not shown), arranged in said upper section (4) on each side of the continuous cut of the flap (50). Thus, by lifting the arm or extension (10) with the finger, the lower or internal section (6, 8, 9) is folded at the second folding line (7) and the upper or external section (4) is folded at the aforementioned weakening points or lines, forcing the surface of the flap (50) and the surface of the upper section (4) to cease being coplanar.

The previous movements cause, thanks to the configuration of the aforementioned components of the cap and to the reinforcement ribs and folding or weakening lines incorporated to the different parts of the cap (1), the creation of a triangle formed by the lower, rear, or internal section (6, 8, 9) when it is folded in two areas at the second folding line (7), a first area (6) of the lower section (6, 8, 9) and a second area (8) of said lower section, together with the flap (50) in the upper section (4). Said flap (50) forms the third side of the triangle when it is separated from the upper section (4).

The upper side (53) and recess (55) making up the M of the flap (50), together with the other two lateral sides (51, 52) constitute the supporting side of the triangle previously formed on the circular body (2) of the cap, and specifically on at least one of the folding points (3) of the perimeter of the circular body (2) when the recess (55) of the flap (50) is made to coincide with said fold (3), to thus generate a supporting point or area of said flap on the circular body (2) without the risk of the flap being displaced and thus ensuring the opening of the crown cap (1).

Once the recess (55) of the M-shaped flap (50) is supported, and continuing with the lifting of the arm (10), preferably pushed by the thumb, the force or pressure of said recess (55) of the M-shaped flap (50) on one of the folds (3) of the circular body (2), causes the deformation of said circular body (2) of the cap (1) which enables the removal thereof from the mouth of the bottle, and therefore, the opening of the bottle. To prevent the deformation of the flap (50) while pushing on the first folding line (5), said flap comprises the aforementioned ribs (60) located between the recess (55) and each lateral side (51, 52).

The invention claimed is:

1. A crown cap, configured from a sheet with a circular body perimetrally presenting, after being adjusted to the rim of the mouth of a bottle, a plurality of folds, wherein the sheet comprises an extension or arm arising from the circular body with a continuous cut or die-cutting in the extension which determines a flap with a surface with three sides, two lateral sides and an upper side closer to the circular body, being joined to the upper, external or front section by the lower side opposite to the upper side of the flap, further presenting:

a first transverse folding line to determine a folded arm with two sections, the first upper, external, or front section and a lower, internal, or rear section, located between the upper, external or front section and the bottle; and said continuous cut being on the upper, external or front section of the extension, and characterized in that the upper side of the flap closer to the circular body comprises at least one recess intended to house at least one of the folds of the circular body.

2. The cap according to claim 1, characterized in that it comprises a rib on the flap between the recess and each lateral side.

3. The cap according to claim 2, characterized in that the ribs are parallel to the lateral sides.

4. The cap according to claim 2, characterized in that the lower end of each rib presents a calibrated stamping which allows folding the flap over the lower side only once.

5. The cap according to claim 1, characterized in that the lower, internal or rear section comprises a second transverse weakening or folding line dividing said section into two areas, a first area and a second area.

6. The cap according to claim 5, characterized in that the lower, internal or rear section comprises longitudinal ribs to provide rigidity to the two areas of said section above and below the second folding line.

7. The cap according to claim 1, characterized in that the borders of the sheet forming it do not present sharp corners to avoid cuts while handling it.

* * * * *